US005573287A

United States Patent [19]

Takimoto

[11] Patent Number: 5,573,287

[45] Date of Patent: Nov. 12, 1996

[54] BILATERAL-TYPE DOOR LOCKING HANDLE ASSEMBLY

[75] Inventor: Kazuhide Takimoto, Tokyo, Japan

[73] Assignee: Takigen Manufacturing Co. Ltd., Tokyo, Japan

[21] Appl. No.: 500,346

[22] Filed: Jul. 10, 1995

[30] Foreign Application Priority Data

Jul. 29, 1994 [JP] Japan ..... 6-197212

[51] Int. Cl.[6] ..... E05C 3/30

[52] U.S. Cl. ..... 292/29; 292/106; 292/DIG. 46; 70/99

[58] Field of Search ..... 292/11, 29, 24, 292/109, 126, 106, 244, 245, DIG. 46; 70/95, 96, 97, 99, 210

[56] References Cited

U.S. PATENT DOCUMENTS

| | | | |
|---|---|---|---|
| 621,574 | 3/1899 | Kinsey | 292/106 X |
| 2,530,330 | 11/1950 | Groeger | 292/29 |
| 2,540,686 | 2/1951 | Milburn | 292/DIG. 46 X |
| 3,040,555 | 6/1962 | Wartian | 70/97 |
| 3,198,564 | 8/1965 | Welsh | 292/DIG. 46 X |
| 4,511,166 | 4/1985 | Weinerman | 292/106 X |
| 5,221,115 | 6/1993 | Takimoto | 292/DIG. 46 X |

FOREIGN PATENT DOCUMENTS

| | | | |
|---|---|---|---|
| 476761 | 8/1915 | France | 70/99 |
| 828498 | 1/1952 | Germany | 70/99 |
| 99476 | 6/1923 | Switzerland | 70/99 |
| 376475 | 7/1932 | United Kingdom | 292/29 |
| 972631 | 10/1964 | United Kingdom | 70/99 |

*Primary Examiner*—Rodney M. Lindsey
*Attorney, Agent, or Firm*—Martin Smolowitz

[57] ABSTRACT

A bilateral-type door locking handle assembly is disclosed. The assembly, owing to its bilaterality, can be employed in both a leftward- and a rightward-retractable door unit to enable its maker to save manufacturing costs and stock space of the product, in which: left latch 25 and right latch 28 are pivoted to pivot 22; lock plate 18 is vertically slidably moved by projection 41 of lever 17 connected with both rotor 19 of lock 12 and base shaft 14 of thumb turn 15, the projection being so arranged as to be pushed by plate 36 fixed to the rotor; notches 30 and 31 abutting on a left and a right surface of plate 29 of the lock plate are provided in shoulders of the left and the right latch, respectively; and, driving plate 40 is provided in an upper end of rear handle 9 so as to project therefrom and abut against each of arm 37 of the left latch and arm 38 of the right latch, the rear handle being interlocked with a front handle 6.

2 Claims, 6 Drawing Sheets

BILATERAL-TYPE DOOR LOCKING HANDLE ASSEMBLY

BACKGROUND OF THE INVENTION

1. Field of the Invention

The present invention relates to a bilateral-type door locking handle assembly employed in a doorway of a ship's cabin.

2. Description of the Prior Art

Conventional door units provided in cabin's doorways of yachts and the like comprise; hinged door units in each of which a door's rotation on a hinge pin opens the doorway; and, retractable or sliding door units in each of which a door's retracting or sliding movement linearly guided by a rail opens the doorway. The retracting or sliding door units further comprise: ones in each of which a door is moved to the left to open the doorway (hereinafter referred to leftward-retractable door units); and, the other ones in each of which a door is moved to the right to open the doorway (hereinafter referred to rightward-retractable door units).

As for a conventional door locking handle assembly, it is possible for a user to mount the handle assembly in only a predetermined one of a left side and a right side of a door. In other words, it is not possible for the user to replace the handle assembly (which is designed for use in the leftward-retractable door unit) with that designed for use in the rightward-retractable door unit or vice versa. Consequently, it is required for the manufacturers to produce two different types of the handle assemblies and stock them separately, which requires a large stock space and makes it difficult to save manufacturing costs.

Further, in the conventional door locking handle assembly, since both a thumb turn and a lock unit hereof are directly interlocked with latch plates of the assembly, there is a fear that both the thumb turn and the lock unit are damaged in operation and construction when a user strains to rotate a front and a rear handle of the assembly in a condition in which the assembly is locked.

SUMMARY OF THE INVENTION

It is an object of the present invention to provide a bilateral-type door locking handle assembly, which is employed in both the leftward-retractable and the rightward-retractable door units, and, therefore makes it possible to produce only one type of the handle assembly through mass production to save manufacturing costs and stock space of the product.

It is another object of the present invention to provide a bilateral-type door locking handle assembly in which both a thumb turn and a lock unit thereof are not directly interlocked with latch plates of the assembly, so that both of the thumb turn and the lock unit are not damaged even when a user strains to rotate a front and a rear handle of the assembly in a condition in which the assembly is locked.

The above objects of the present invention are accomplished by providing:

a bilateral-type door locking handle assembly comprising:

a front casing fixedly mounted on a front side of a door;

a rear casing fixedly mounted on a rear side of the door;

a front handle having its base-end portion rotatably mounted on a stationary shaft passing through both the front casing and the rear casing;

a rear handle having its base-end portion rotatably mounted on the stationary shaft;

a base plate which is received in the rear casing and fixedly mounted on the door;

a lock unit which is fixedly mounted on the base plate and has its front-end portion received in a through-hole of the front casing;

a thumb turn having its base-end shaft portion mounted rotatably in a bearing portion of the rear casing;

an operating lever connected with the base-end shaft portion of the thumb turn;

a position-retaining spring which is interposed between the base-end portion of the operating lever and the rear casing, and reversed in its force-exerting direction with a corresponding change in angular position of the operating lever in rotation so as to urge the operating lever to its locking position or its unlocking position;

a lock plate which is housed in the rear casing, and vertically guided slidably by a guide pin which is fixedly mounted on the rear casing so as to pass through an elongated hole of the lock plate;

a cam projection provided in a front-end portion of the operating lever so as to urge a lower-edge portion of a follower hole of the lock plate;

an operating-arm plate fixedly mounted on a rotor of the lock unit so as to have a lower side of its front-end portion urge an upper side of the cam projection downward;

a left-side latch plate which has its base-end portion rotatably mounted on a fixed pivot of the rear casing, and has a front-end hook portion thereof projected from a left-side opening of the rear casing;

a right-side latch plate which has its base-end portion rotatably mounted on the fixed pivot of the rear casing, and has a front-end hook portion thereof projected from a right-side opening of the rear casing;

a locking notch provided in a shoulder portion of the left-side latch plate so as to engage with a left-side surface of a locking-plate portion of a lower-end portion of the lock plate;

a locking notch provided in a shoulder portion of the right-side latch plate so as to engage with a right-side surface of the locking-plate portion of the lower-end portion of the lock plate;

a spring disposed between the left-side latch plate and the right-side latch plate in the rear casing so as to bias both the left-side latch plate and the right-side latch plate into their locking positions;

an interlocking shaft through which the front handle and the rear handle are integrally rotated;

a driving plate which is provided in an upper-end portion of the rear handle so as to project therefrom and abut against each of a follower arm portion of the left-side latch plate and a follower arm portion of the right-side latch plate;

a spring disposed between the front casing and the front handle so as to bias the front handle into its locking position;

a spring disposed between the rear casing and the rear handle so as to bias the rear handle into its locking position;

a key which is inserted into the rotor of the lock unit and operated so as to slidably move the lock plate into its locking position through the operating-arm plate;

a socket piece provided in a left-side post wall of a doorway so as to be engaged with and disengaged from the front-end hook portion of the left-side latch plate; and a socket piece provided in a right-side post wall of the doorway so as to be engaged with and disengaged from the front-end hook portion of the right-side latch plate.

DESCRIPTION OF THE PREFERRED EMBODIMENTS

Figure 1:
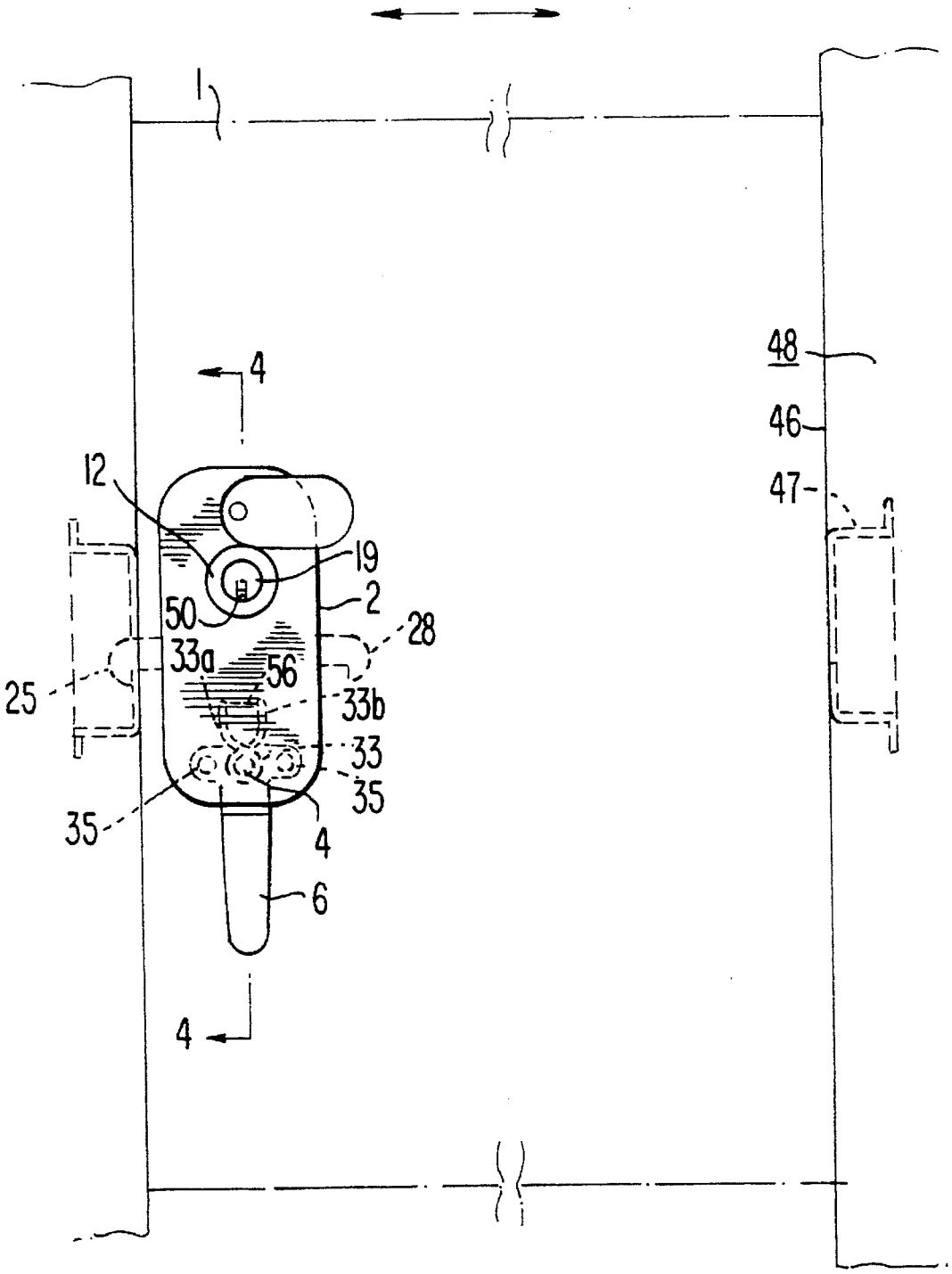
FIG. 1 is a front view of an embodiment of the door locking handle assembly of the present invention employed in a rightward-retractable door unit, in the condition in which a doorway is closed by the door unit.
Figure 2:
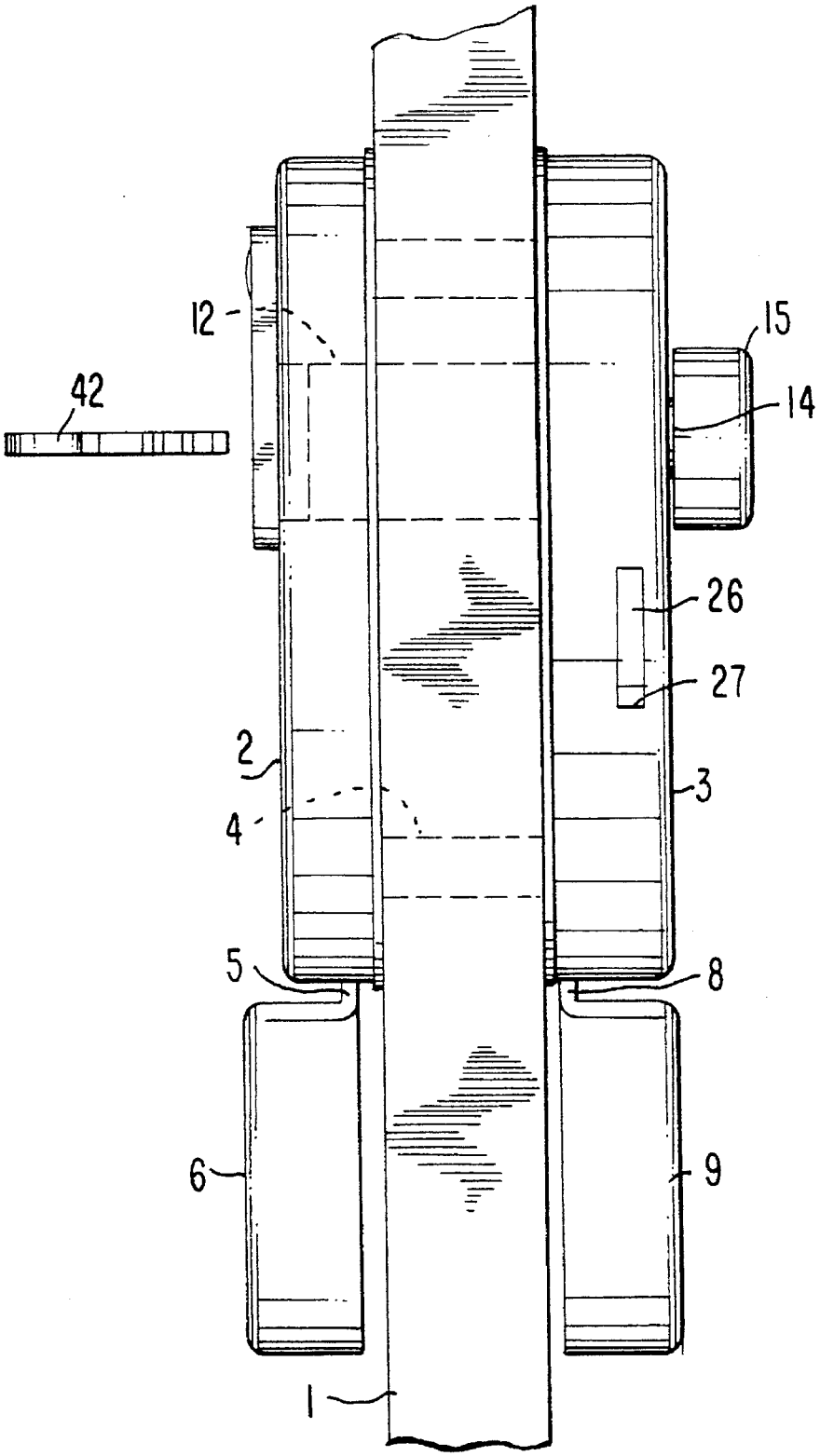
FIG. 2 is a right side view of the door locking handle assembly of the present invention shown in FIG. 1.
Figure 3:
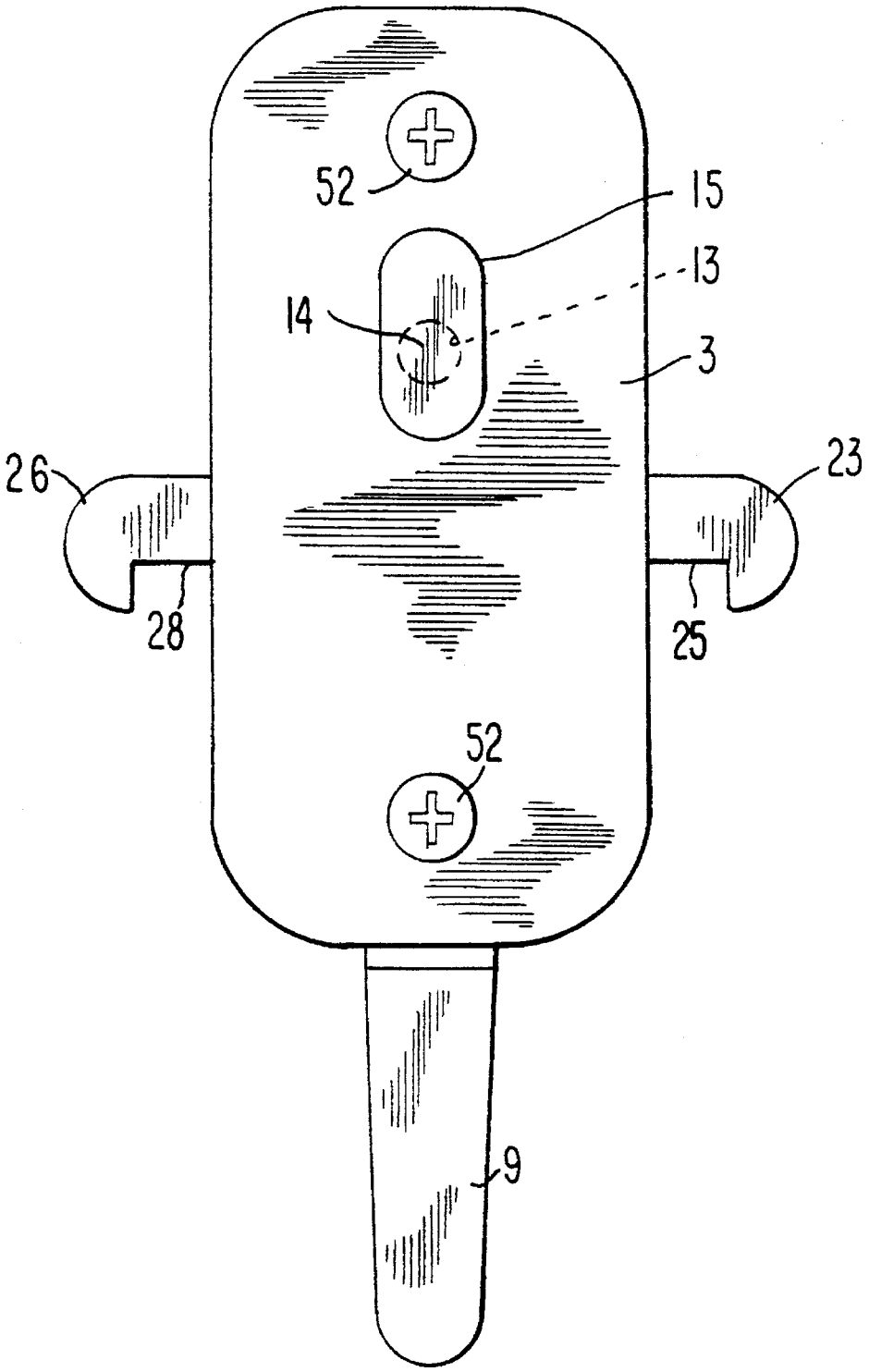
FIG. 3 is a rear view of the door locking assembly of the present invention shown in FIG. 1.

Hereinbelow, the present invention will be described in detail with reference to the accompanying drawings and the reference numerals and characters therein.

A bilateral-type door locking handle assembly of the present invention comprises:

a front casing 2 fixedly mounted on a front side of a door 1; a rear casing 3 fixedly mounted on a rear side of the door 1; a front handle 6 having its base-end portion 5 rotatably mounted on a stationary shaft 4 passing through both the front casing 2 and the rear casing 3; a rear handle 9 having its base-end portion 8 rotatably mounted on the stationary shaft 4; a base plate 10 which is received in the rear casing 3 and fixedly mounted on the door 1; a lock unit 12 which is fixedly mounted on the base plate 10 and has its front-end portion received in a through-hole 11 of the front casing 2; a thumb turn 15 having its base-end shaft portion 14 mounted rotatably in a bearing portion 13 of the rear casing 3; an operating lever 17 connected with the base-end shaft portion 14 of the thumb turn 15; and, a position-retaining spring 21 which is interposed between the base-end portion of the operating lever 17 and the rear casing 3, and reversed in its force-exerting direction with a corresponding change in angular position of the operating lever 17 in rotation so as to urge the operating lever 17 to its locking position or its unlocking position.

This door locking handle assembly of the present invention further comprises: a lock plate 18 which is housed in the rear casing 3, and is vertically guided slidably by a guide pin 20 which is fixedly mounted on the rear casing 3 so as to pass through an elongated hole 16 of the lock plate 18; a cam projection 41 provided in a front-end portion of the operating lever 17 so as to urge a lower-edge portion of a follower hole 39 of the lock plate 18; an operating-arm plate 36 fixedly mounted on a rotor 19 of the lock unit 12 so as to have a lower side of its front-end portion urge an upper side of the cam projection 41 downward; a left-side latch plate 25 which has its base-end portion rotatably mounted on a fixed pivot 22 of the rear casing 3, and has a front-end hook portion 23 thereof projected from a left-side opening 24 of the rear casing 3; a right-side latch plate 28 which has its base-end portion rotatably mounted on the fixed pivot 22 of the rear casing 3, and has a front-end hook portion 26 thereof projected from a right-side opening 27 of the rear casing 3; a locking notch 30 provided in a shoulder portion of the left-side latch plate 25 so as to engage with a left-side surface of a locking-plate portion 29 of a lower-end portion of the lock plate 18; and, a locking notch 31 provided in a shoulder portion of the right-side latch plate 28 so as to engage with a right-side surface of the locking-plate portion 29 of the lower-end portion of the lock plate 18.

Still further, this door locking handle assembly of the present invention comprises: a spring 32 disposed between the left-side latch plate 25 and the right-side latch plate 28 in the rear casing 3 so as to bias both the left-side latch plate 25 and the right-side latch plate 28 into their locking positions; an interlocking shaft 35 through which the front handle 6 and the rear handle 9 are integrally rotated; a driving plate 40 which is provided in an upper-end portion of the rear handle 9 so as to project therefrom and abut against each of a follower arm portion 37 of the left-side latch plate 25 and a follower arm portion 38 of the right-side latch plate 28; a spring 33 disposed between the front casing 2 and the front handle 6 so as to bias the front handle 6 into its locking position; a spring 34 disposed between the rear casing 3 and the rear handle 9 so as to bias the rear handle 9 into its locking position; a key 42 which is inserted into the rotor 19 of the lock unit 12 and operated so as to slidably move the lock plate 18 into its locking position through the operating-arm plate 36; a socket piece 45 provided in a left-side post wall 44 of a doorway 43 so as to be engaged with and disengaged from the front-end hook portion 23 of the left-side latch plate 25; and, a socket piece 47 provided in a right-side post wall 46 of the doorway 43 so as to be engaged with and disengaged from the front-end hook portion 26 of the right-side latch plate 28.

Figure 4:
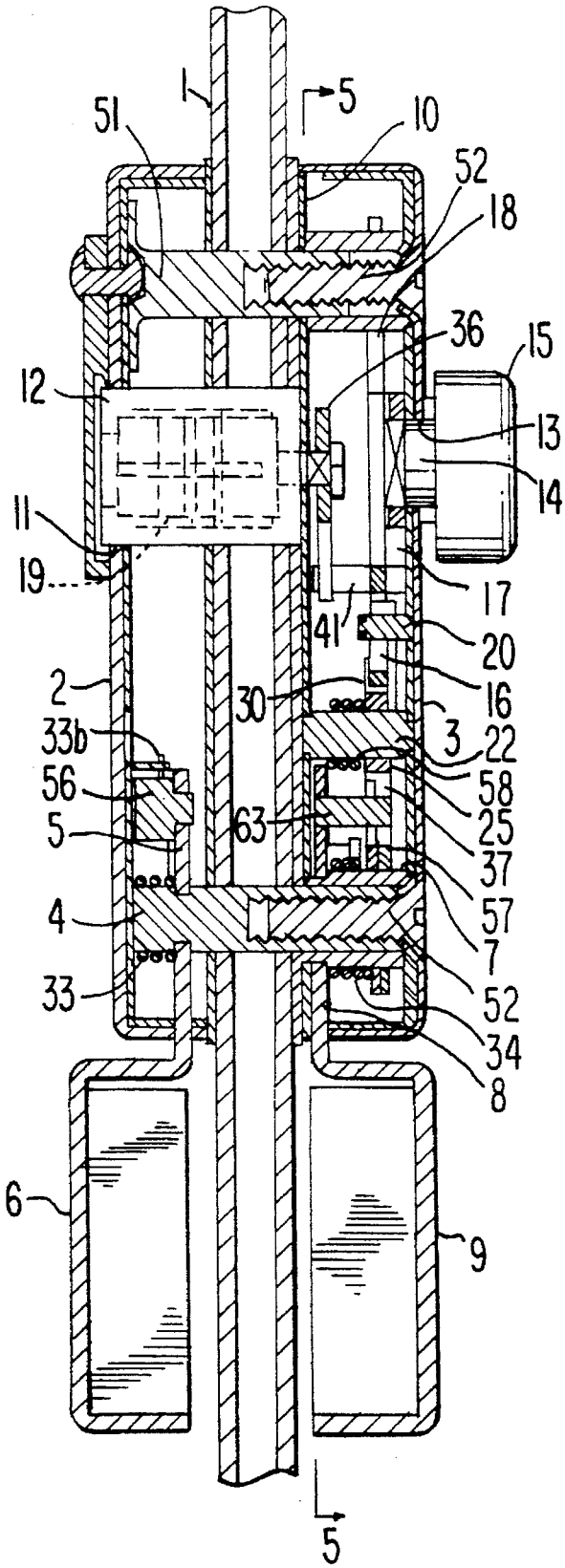
FIG. 4 is a longitudinal sectional view of the door locking assembly of the present invention, taken along the line 4—4 of FIG. 1.

As best shown in FIG. 4, the front casing 2 and rear casing 3 are each fixedly mounted onto the door 1 by two screws 52, with an upper screw 52 being threaded into a bushing 51 and a lower screw 52 being threaded into the stationary shaft 4.

Figure 5:
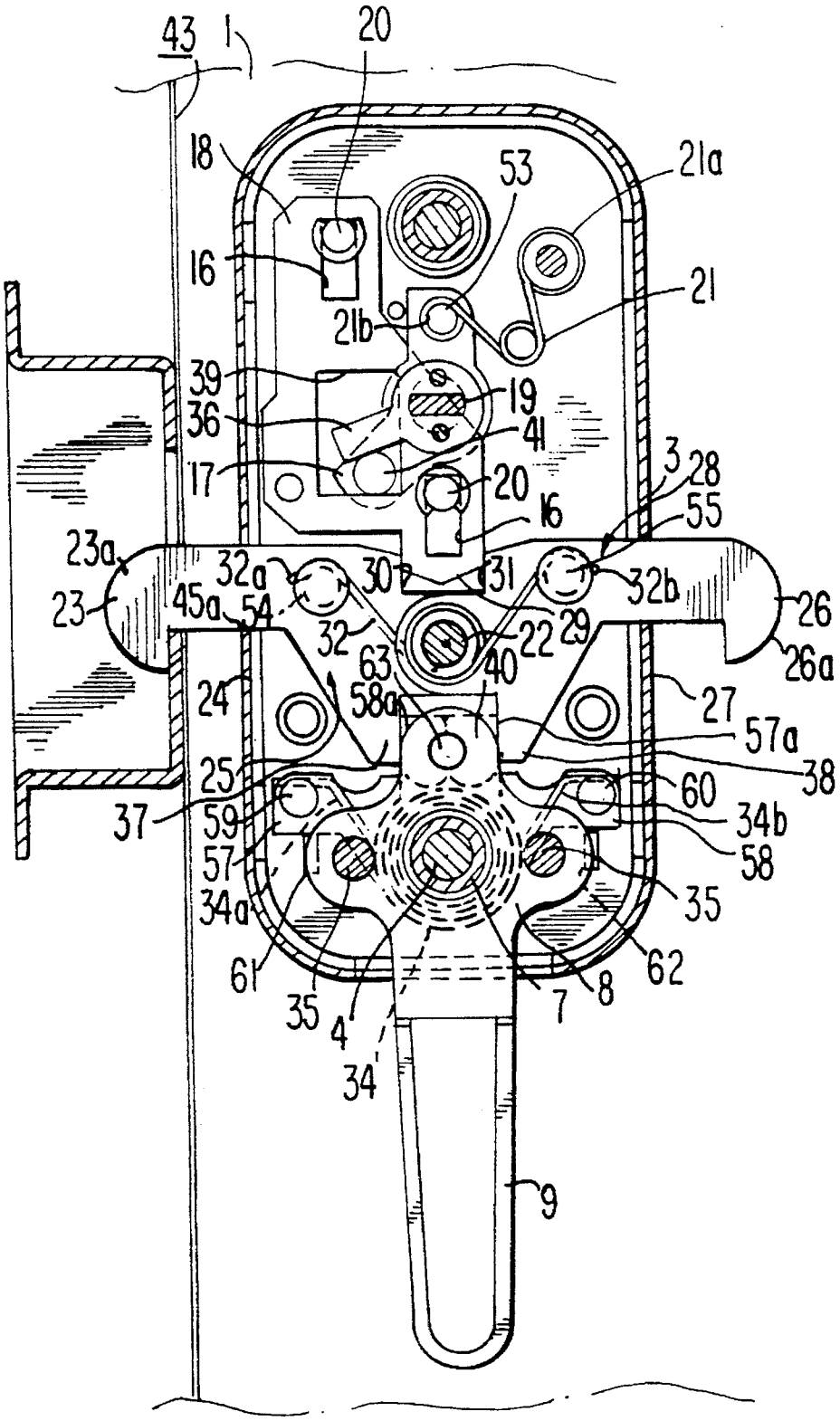
FIG. 5 is a longitudinal sectional view of the door locking assembly of the present invention, taken along the line 5—5 of FIG. 4.

In operation, in case that the door locking handle assembly of the present invention is employed in the rightward-retractable door unit, when a user grips the front handle 6 or the rear handle 9 and then slidably move the door 1 to the left so that the doorway 43 is closed, a circularly-curved cam surface **23*a* of the front-end hook portion 23 of the left-side latch plate 25 abuts on an opening edge portion 45*a* of the socket piece 45 and then temporarily rotated clockwise thereby at the end of such door-closing operation, as viewed in FIG. 5. Once the door 1 has reached the left-side post wall 44 so that the front-end hook portion 23 has passed through the opening edge portion 45*a* of the socket piece 45, the left-side latch plate 25 is rotatably driven counterclockwise under the influence of a resilient force exerted by the spring 32 so that the front-end hook portion 23 firmly engages with the socket piece 45. Since such engagement of the front-end hook portion 23 with the socket piece 45 is maintained under the influence of the resilient force of the spring 32, it is possible to keep the door 1** closed.

In the case of locking the door 1 from its front side, the key 42 is inserted into a key hole 50 of the lock unit 12 to rotate the operating-arm plate 36 counterclockwise, as viewed in FIG. 5. As a result, the cam projection 41 of the operating lever 17 is moved down so that the lever 17 is also rotated counterclockwise. At the same time, the cam projection 41 of the operating lever 17 also pushes the edge portion of the follower hole 39 of the lock plate 18 so as to move the lock plate 18 downward. As a result, the locking-plate portion 29 of the lock plate 18 abuts on the locking notch 30 of the left-side latch plate 25.

On the other hand, in the case of locking the door 1 from its rear side, the thumb turn 15 is rotated to have the cam projection 41 of the operating lever 17 push the edge portion of the follower hole 39 of the lock plate 18 so that the plate 18 is slidably moved down, whereby the locking-plate portion 29 of the lock plate 18 abuts on the locking notch 30 of the left-side latch plate 25. Consequently, the left-side latch plate 25 is prevented from rotating clockwise, and, therefore stays in its locked position. Since it is possible for any of the key 42 and the thumb turn 15 to prevent the left-side latch plate 25 from rotating clockwise, it is impossible for any of the front handle 6 and the rear handle 9 to open the door 1, so that the door 1 stays in its locked position.

In the case of opening the door 1 from its front side, the key 42 is inserted into the key hole 50 of the rotor 19 of the lock unit 12 and considerably rotates the operating-arm plate 36 clockwise as viewed in FIG. 5 so as to push up the cam projection 41 of the operating lever 17 from its lower side, whereby the operating lever 17 is rotated clockwise. As a result, the cam projection 41 of the operating lever 17 pushes the edge portion of the follower hole 39 of the lock plate 18 so as to slidably move the plate 18 upward, so that the locking-plate portion 29 of the lock plate 18 is disengaged from the locking notch 30 of the left-side latch plate 25, whereby the left-side latch plate 25 is released from the lock plate 18.

Figure 6:
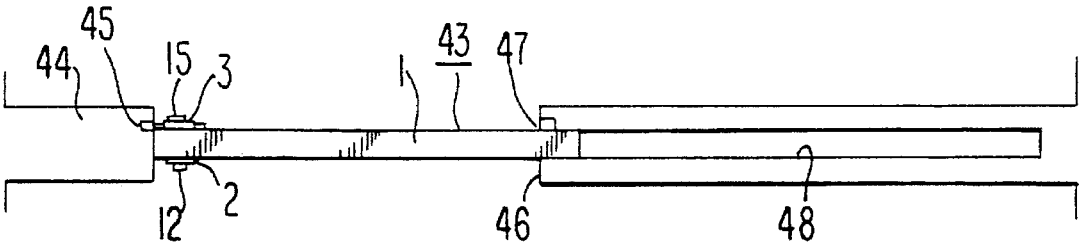
FIG. 6 is a schematic plan view of the rightward-retractable door unit employing the door locking assembly of the present invention.
Figure 7:
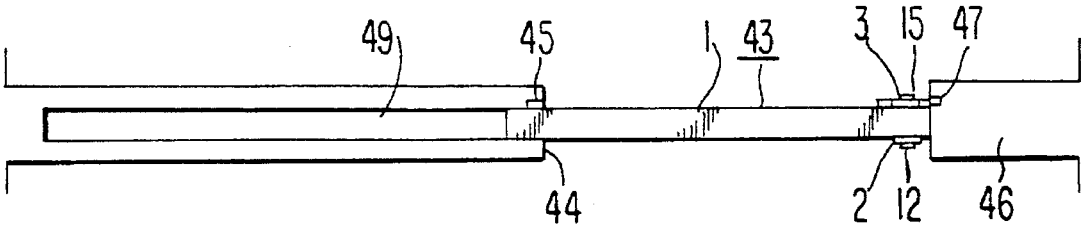
FIG. 7 is a schematic plan view of the leftward-retractable door unit employing the door locking assembly of the present invention.

Under such circumstances, when the front handle 6 is rotated counterclockwise on the stationary shaft 4 as viewed in FIG. 5, the rear handle 6 is also rotated in the same direction as that of the front handle 6 through the interlocking shaft 35 through which the rear handle 9 is interlocked with the front handle 6. As a result of this rotating operation of the front handle 6, the driving plate 40 of the rear handle 9 pushes the follower arm 37 of the left-side latch plate 25 so as to rotate the left-side latch plate 25 clockwise as viewed in FIG. 5, whereby the front-end hook portion 23 of the latch plate 25 is disengaged or released from the socket piece 45. During rotation of the operating lever 17, the position-retaining spring 21, which is interposed between the base-end portion of the operating lever 17 and the rear casing 3, is reversed in its force-exerting direction with a corresponding change in angular position of the operating lever 17 in such rotation so as to urge the operating lever 17 to its locking position, whereby the lever 17 is steadily maintained in its locking position. Under such circumstances, when the front handle 6 is pulled to the right in FIG. 6, the door 1 is separated from the left-side post wall 44 and then retracted from the doorway 43 so as to be housed in the door-housing portion 48, whereby the doorway 43 is opened.

In the case of opening the door 1 from its rear side, the thumb turn 15 is rotated so that the operating lever 17 is rotated clockwise as viewed in FIG. 5, so that the edge portion of the follower hole 39 of the lock plate 18 is pushed by the cam projection 41 of the operating lever 17, whereby the lock plate 18 is slidably moved upward. As a result, the locking-plate portion 29 of the lock plate 18 is disengaged from the locking notch 30 of the left-side latch plate 25 so that the lock plate 18 is released when the rear handle 9 is rotated counterclockwise on the stationary shaft 4 as viewed in FIG. 5, the driving plate 40 of the rear handle 9 pushes the follower arm 39 of the left-side latch plate 25 so that the latch plate 25 is rotated clockwise to have its front-end hook portion 23 disengaged from the socket piece 45. Thereafter, when the rear handle 9 is pulled, the door 1 is separated from the left-side post wall 44 and retracted from the doorway 43 so as to be housed in the door-housing portion 48, whereby the doorway 43 is opened.

Even when the door 1 is operated at either side of the door 1, the circularly-curved cam surface 26*a* of the front-end hook portion 26 of the the right-side latch plate 28 abuts on the opening edge portion

What is claimed is:

1. A bilateral-type door locking handle assembly, comprising:

a front casing (2) fixedly mounted on a front side of a door (1);

a rear casing (3) fixedly mounted on a rear side of said door (1);

a front handle (6) having its base-end portion (5) rotatably mounted on a stationary shaft (4) passing through both said front casing (2) and said rear casing (3);

a rear handle (9) having its base-end portion (8) rotatably mounted on said stationary shaft (4);

a base plate (10) which is received in said rear casing (3), fixedly mounted on said door (1);

a lock unit (12) which is fixedly mounted on said base plate (10) and has its front-end portion received in a through-hole (11) of said front casing (2);

a thumb turn (15) having its base-end shaft portion (14) mounted rotatably in a bearing portion (13) of said rear casing (3);

an operating lever (17) connected with said base-end shaft portion (14) of said thumb turn (15);

a position-retaining spring (21) which is interposed between a portion of said operating lever (17) and said rear casing (3), and reversible in its force-exerting direction with a corresponding change in angular position of the operating lever (17) in rotation so as to urge said operating lever (17) to its locking position or its unlocking position;

a lock plate (18) which is housed in said rear casing (3), and vertically guided slidably by a guide pin (20) which is fixedly mounted on said rear casing (3) so as to pass through an elongated hole (16) of said lock plate (18);

a cam projection (41) provided in a front-end portion of said operating lever (17) so as to urge a lower-edge portion of a follower hole (39) of said lock plate (18);

an operating-arm plate (36) fixedly mounted on a rotor (19) of said lock unit (12) so as to have a lower side of its front-end portion urge an upper side of said cam projection (41) downward;

a left-side latch plate (25) which has its base-end portion rotatably mounted on a fixed pivot (22) of said rear casing (3), and has a front-end hook portion (23) thereof projected from a left-side opening (24) of said rear casing (3);

a right-side latch plate (28) which has its base-end portion rotatably mounted on a fixed pivot (22) of said rear casing (3), and has a front-end hook portion (26)

thereof projected from a right-side opening (27) of said rear casing (3);

a locking notch (30) provided in a shoulder portion of said left-side latch plate (25) so as to engage with a left-side surface of a locking-plate portion (29) of a lower-end portion of said lock plate (18);

a locking notch (31) provided in a shoulder portion of said right-side latch plate (28) so as to engage with a right-side surface of said locking-plate portion (29) of said lower-end portion of said lock plate (18);

a spring (32) disposed between said left-side latch plate (25) and said right-side latch plate (28) in said rear casing (3) so as to bias both said left-side latch plate (25) and right-side latch plate (28) into their locking position;

an interlocking shaft (35) through which said front handle (6) and said rear handle (9) are integrally rotated;

a driving plate (40) which is provided in an upper-end portion of said rear handle (9) so as to project therefrom and abut against each of a follower arm portion (37) of said left-side latch plate (25) and a follower arm portion (38) of said right-side latch plate (28);

a spring (33) disposed between said front casing (2) and said front handle (6) so as to bias said front handle (6) into its locking position;

a spring (34) disposed between said rear casing (3) and said rear handle (9) so as to bias said rear handle (9) into its locking position;

a key (42) which is inserted into said rotor (19) of said lock unit (12) and operated so as to slidably move said lock plate (18) into its locking position through said operating-arm plate (36);

a socket piece (45) provided in a left-side post wall (44) of a doorway (43) so as to be engaged with and disengaged from said front-end hook portion (23) of said left-side latch plate (25); and a socket piece (47) provided in a right-side post wall (46) of said doorway (43) so as to be engaged with and disengaged from said front-end hook portion (26) of said right-side latch plate (28).

2. The bilateral-type door locking handle assembly of claim 1, wherein said front casing (2) and said rear casing (3) are each fixedly mounted onto said door (1) by two screws (52), one screw (52) being threaded into a bushing (51) and the other screw (52) being threaded into said stationary shaft (4).

* * * * *